US009030119B2

(12) United States Patent
Jin

(10) Patent No.: US 9,030,119 B2
(45) Date of Patent: May 12, 2015

(54) LED STRING DRIVER ARRANGEMENT WITH NON-DISSIPATIVE CURRENT BALANCER

(75) Inventor: Xiaoping Jin, Orange, CA (US)

(73) Assignee: Microsemi Corporation, Aliso Viejo, CA (US)

( * ) Notice: Subject to any disclaimer, the term of this patent is extended or adjusted under 35 U.S.C. 154(b) by 772 days.

(21) Appl. No.: 13/175,899

(22) Filed: Jul. 4, 2011

(65) Prior Publication Data

US 2012/0013259 A1 Jan. 19, 2012

Related U.S. Application Data

(60) Provisional application No. 61/365,356, filed on Jul. 19, 2010, provisional application No. 61/482,116, filed on May 3, 2011.

(51) Int. Cl.
*H05B 41/24* (2006.01)
*H05B 33/08* (2006.01)

(52) U.S. Cl.
CPC ..... *H05B 33/0827* (2013.01)

(58) Field of Classification Search
CPC ..... H05B 37/02; H05B 43/00; H05B 33/08; H05B 33/0827; H05B 37/00
USPC ..... 315/177, 185 R, 246, 254–255, 279, 315/282, 291, 294
See application file for complete search history.

(56) References Cited

U.S. PATENT DOCUMENTS 2,429,162 A 10/1947 Keiser et al.
2,440,984 A 5/1948 Summers
2,572,258 A 10/1951 Goldfield et al.
2,965,799 A 12/1960 Brooks et al.
2,968,028 A 1/1961 Goto et al.
3,141,112 A 7/1964 Eppert
3,565,806 A 2/1971 Ross (Continued)

FOREIGN PATENT DOCUMENTS

EP 0326114 8/1989
EP 0587923 3/1994

(Continued)

OTHER PUBLICATIONS

Dubey, "Thyristorised Power Controllers"; Halsted Press, 1986; pp. 74-77.*

(Continued)

*Primary Examiner* — Douglas W Owens
*Assistant Examiner* — Henry Luong
(74) *Attorney, Agent, or Firm* — Simon Kahn

(57) ABSTRACT

A solid state lighting driver arrangement exhibiting a plurality of LED strings receiving power from a single power source, the single power source providing a discontinuous current, wherein a plurality of first windings are provided, each associated with a particular LED string and coupled to provide current balancing between the various LED strings. The discontinuous current resets the windings during the off time or during a reversal period. In one particular embodiment, a second winding is magnetically coupled to each of the first windings, and the second windings are connected in a closed in-phase loop. In another particular embodiment, at least two of the first windings are magnetically coupled to each other, thus ensuring a balance between current in each LED string.

5 Claims, 9 Drawing Sheets

(56) References Cited

U.S. PATENT DOCUMENTS 3,597,656 A 8/1971 Douglas
3,611,021 A 10/1971 Wallace
3,683,923 A 8/1972 Anderson
3,737,755 A 6/1973 Calkin et al.
3,742,330 A 6/1973 Hodges et al.
3,936,696 A 2/1976 Gray
3,944,888 A 3/1976 Clark
4,060,751 A 11/1977 Anderson
4,353,009 A 10/1982 Knoll
4,388,562 A 6/1983 Josephson
4,441,054 A 4/1984 Bay
4,463,287 A 7/1984 Pitel
4,523,130 A 6/1985 Pitel
4,562,338 A 12/1985 Okami
4,567,379 A 1/1986 Corey et al.
4,572,992 A 2/1986 Masaki
4,574,222 A 3/1986 Anderson
4,622,496 A 11/1986 Dattilo et al.
4,630,005 A 12/1986 Clegg et al.
4,663,566 A 5/1987 Nagano
4,663,570 A 5/1987 Luchaco et al.
4,672,300 A 6/1987 Harper
4,675,574 A 6/1987 Delflache
4,686,615 A 8/1987 Ferguson
4,698,554 A 10/1987 Stupp et al.
4,700,113 A 10/1987 Stupp et al.
4,761,722 A 8/1988 Pruitt
4,766,353 A 8/1988 Burgess
4,780,696 A 10/1988 Jirka
4,847,745 A 7/1989 Shekhawat et al.
4,862,059 A 8/1989 Tominaga et al.
4,893,069 A 1/1990 Harada et al.
4,902,942 A 2/1990 El-Hamamsy
4,939,381 A 7/1990 Shibata et al.
5,023,519 A 6/1991 Jensen
5,030,887 A 7/1991 Guisinger
5,036,255 A 7/1991 McKnight et al.
5,057,808 A 10/1991 Dhyanchand
5,173,643 A 12/1992 Sullivan et al.
5,349,272 A 9/1994 Rector
5,434,477 A 7/1995 Crouse et al.
5,475,284 A 12/1995 Lester et al.
5,485,057 A 1/1996 Smallwood et al.
5,519,289 A 5/1996 Katyl et al.
5,539,281 A 7/1996 Shackle et al.
5,557,249 A 9/1996 Reynal
5,563,473 A 10/1996 Mattas et al.
5,574,335 A 11/1996 Sun
5,574,356 A 11/1996 Parker
5,615,093 A 3/1997 Nalbant
5,619,402 A 4/1997 Lin
5,621,281 A 4/1997 Kawabata et al.
5,652,479 A 7/1997 LoCascio et al.
5,712,776 A 1/1998 Palara et al.
5,754,012 A 5/1998 LoCascio et al.
5,818,172 A 10/1998 Lee
5,822,201 A 10/1998 Kijima
5,825,133 A 10/1998 Conway
5,828,156 A 10/1998 Roberts
5,854,617 A 12/1998 Lee et al.
5,892,336 A 4/1999 Lin et al.
5,910,713 A 6/1999 Nishi et al.
5,912,812 A 6/1999 Moriarty, Jr.
5,914,842 A 6/1999 Sievers
5,923,129 A 7/1999 Henry
5,930,121 A 7/1999 Henry
5,930,126 A 7/1999 Griffin et al.
5,936,360 A 8/1999 Kaneko
6,002,210 A 12/1999 Nilssen
6,020,688 A 2/2000 Moisin
6,028,400 A 2/2000 Pol et al.
6,037,720 A 3/2000 Wong et al.
6,038,149 A 3/2000 Hiraoka et al.
6,040,662 A 3/2000 Asayama
6,043,609 A 3/2000 George et al.
6,049,177 A 4/2000 Felper
6,072,282 A 6/2000 Adamson
6,104,146 A 8/2000 Chou et al.
6,108,215 A 8/2000 Kates et al.
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,150,772 A 11/2000 Crane
6,169,375 B1 1/2001 Moisin
6,181,066 B1 1/2001 Adamson
6,181,083 B1 1/2001 Moisin
6,181,084 B1 1/2001 Lau
6,188,553 B1 2/2001 Moisin
6,198,234 B1 3/2001 Henry
6,198,236 B1 3/2001 O'Neill
6,215,256 B1 4/2001 Ju
6,218,788 B1 4/2001 Chen et al.
6,259,615 B1 7/2001 Lin
6,281,636 B1 8/2001 Okutsu et al.
6,281,638 B1 8/2001 Moisin
6,307,765 B1 10/2001 Choi
6,310,444 B1 10/2001 Chang
6,316,881 B1 11/2001 Shannon et al.
6,320,329 B1 11/2001 Wacyk
6,323,602 B1 11/2001 De Groot et al.
6,344,699 B1 2/2002 Rimmer
6,362,577 B1 3/2002 Ito et al.
6,396,722 B2 5/2002 Lin
6,417,631 B1 7/2002 Chen et al.
6,420,839 B1 7/2002 Chiang et al.
6,433,492 B1 8/2002 Buonavita
6,441,943 B1 8/2002 Roberts et al.
6,445,141 B1 9/2002 Kastner et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,486,618 B1 11/2002 Li
6,494,587 B1 12/2002 Shaw et al.
6,501,234 B2 12/2002 Lin et al.
6,509,696 B2 1/2003 Bruning et al.
6,515,427 B2 2/2003 Oura et al.
6,515,881 B2 2/2003 Chou et al.
6,522,558 B2 2/2003 Henry
6,531,831 B2 3/2003 Chou et al.
6,534,934 B1 3/2003 Lin et al.
6,559,606 B1 5/2003 Chou et al.
6,570,344 B2 5/2003 Lin
6,628,093 B2 9/2003 Stevens
6,633,138 B2 10/2003 Shannon et al.
6,680,834 B2 1/2004 Williams
6,717,371 B2 4/2004 Klier et al.
6,717,372 B2 4/2004 Lin et al.
6,765,354 B2 7/2004 Klein et al.
6,781,325 B2 8/2004 Lee
6,784,627 B2 8/2004 Suzuki et al.
6,804,129 B2 10/2004 Lin
6,864,867 B2 3/2005 Biebl
6,870,330 B2 3/2005 Choi
6,922,023 B2 7/2005 Hsu et al.
6,930,893 B2 8/2005 Vinciarelli
6,936,975 B2 8/2005 Lin et al.
7,242,147 B2 7/2007 Jin
2001/0036096 A1 11/2001 Lin
2002/0030451 A1 3/2002 Moisin
2002/0097004 A1 7/2002 Chiang et al.
2002/0135319 A1 9/2002 Bruning et al.
2002/0140538 A1 10/2002 Yer et al.
2002/0145886 A1 10/2002 Stevens
2002/0171376 A1 11/2002 Rust et al.
2002/0180380 A1 12/2002 Lin
2002/0180572 A1 12/2002 Kakehashi et al.
2002/0181260 A1 12/2002 Chou et al.
2002/0195971 A1 12/2002 Qian et al.
2003/0001524 A1 1/2003 Lin et al.
2003/0015974 A1 1/2003 Klier et al.

(56) References Cited

U.S. PATENT DOCUMENTS

| | | | | |
|---|---|---|---|---|
| 2003/0080695 | A1 | 5/2003 | Ohsawa | |
| 2003/0090913 | A1 | 5/2003 | Che-Chen et al. | |
| 2003/0117084 | A1 | 6/2003 | Stack | |
| 2003/0122502 | A1 | 7/2003 | Clauberg et al. | |
| 2003/0141829 | A1 | 7/2003 | Yu et al. | |
| 2004/0000879 | A1 | 1/2004 | Lee | |
| 2004/0032223 | A1 | 2/2004 | Henry | |
| 2004/0155596 | A1 | 8/2004 | Ushijima et al. | |
| 2004/0257003 | A1 | 12/2004 | Hsieh et al. | |
| 2004/0263092 | A1 | 12/2004 | Liu | |
| 2005/0093471 | A1 | 5/2005 | Jin | |
| 2005/0093472 | A1 | 5/2005 | Jin | |
| 2005/0093482 | A1 | 5/2005 | Ball | |
| 2005/0093483 | A1 | 5/2005 | Ball | |
| 2005/0093484 | A1 | 5/2005 | Ball | |
| 2005/0099143 | A1 | 5/2005 | Kohno | |
| 2005/0156539 | A1 | 7/2005 | Ball | |
| 2005/0162098 | A1 | 7/2005 | Ball | |
| 2005/0225261 | A1 | 10/2005 | Jin | |
| 2006/0022612 | A1 | 2/2006 | Henry | |
| 2008/0061716 | A1 | 3/2008 | Kim | |
| 2008/0116816 | A1 | 5/2008 | Neuman et al. | |
| 2008/0136769 | A1 | 6/2008 | Kim et al. | |
| 2010/0109560 | A1 | 5/2010 | Yu et al. | |
| 2010/0194199 | A1 | 8/2010 | Kimura et al. | |
| 2010/0270945 | A1* | 10/2010 | Chang et al. | 315/294 |
| 2011/0068700 | A1* | 3/2011 | Fan | 315/185 R |
| 2011/0216567 | A1* | 9/2011 | Fan | 363/131 |

FOREIGN PATENT DOCUMENTS

| | | | |
|---|---|---|---|
| EP | 0597661 | | 5/1994 |
| EP | 0647021 | A1 | 9/1994 |
| EP | 1956288 | A1 | 8/2008 |
| JP | 5-90897 | | 12/1993 |
| JP | 06168791 | A | 6/1994 |
| JP | 8-204488 | | 8/1996 |
| JP | 11305196 | A | 11/1999 |
| TW | 485701 | | 5/2002 |
| TW | 556860 | | 1/2003 |
| TW | 0554643 | | 9/2003 |
| TW | 200501829 | | 1/2005 |
| WO | WO 94/15444 | | 7/1994 |
| WO | WO 96/38024 | | 11/1996 |

OTHER PUBLICATIONS

Williams, B.W.; "Power Electronics Devices, Drivers, Applications and Passive Components"; Second Edition, McGraw-Hill, 1992; Chapter 10, pp. 218-249.

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

Supplementary European Search Report for Application No. EP 04794179, dated May 15, 2007.

Examination Report for Application No. EP 04794179, dated Oct. 16, 2007.

Taiwan Examination Report for Application No. 094110958, dated Mar. 20, 2008, 9 pages.

Baddela S M et al; Parallel Connected LEDs Operated at High Frequency to Improve Current Sharing; Industry Applications Conference 2004, 39th IAS Annual Meeting, pp. 1677-1681, published Oct. 2004, IEEE Piscataway, NJ.

Sungjin Choi et al; Symmetric Current Balancing Circuit for Multiple DC Loads; Applied Power Electronics Conference and Exposition 2010; pp. 512-518, published Feb. 2010, IEEE Piscataway, NJ.

Werner Thomas et al; "A Novel Low-Cost Current-Sharing Method for Automotive LED Lighting Systems"; 13th European Conference on Power Electronics and Applications, 2009; pp. 1-10, published Sep. 2009, IEEE Piscataway, NJ.

International Search Report by European Patent Office for Parallel PCT application PCT/US2011/042909 dated Feb. 6, 2012.

Written Opinion of the International Searching Authority by European Patent Office for Parallel PCT application PCT/US2011/042909 dated Feb. 6, 2012.

* cited by examiner

LED STRING DRIVER ARRANGEMENT WITH NON-DISSIPATIVE CURRENT BALANCER

CROSS REFERENCE TO RELATED APPLICATIONS

This application claims priority from: U.S. Provisional Patent Application Ser. No. 61/365,356 filed Jul. 19, 2010 entitled "LED String Driver with Non-Dissipative Current Balancer"; and U.S. Provisional Patent Application Ser. No. 61/482,116 filed May 2, 2011 entitled "High Efficiency LED Driving Method", the entire contents of each of which are incorporated herein by reference.

BACKGROUND OF THE INVENTION

The present invention relates to the field of solid state lighting, and in particular to a plurality of LED strings coupled to a common power source in parallel and comprising a non-dissipative current balancer.

Light emitting diodes (LEDs) and in particular high intensity and medium intensity LED strings are rapidly coming into wide use for lighting applications due their high efficiency, long life, mechanical compactness and robustness, and low voltage operation, without limitation. LEDs with an overall high luminance are useful in a number of applications including backlighting for liquid crystal display (LCD) based monitors and televisions, collectively hereinafter referred to as a matrix display, as well as for general lighting applications. Due to the limited power capacity of a single LED device, in many applications multiple LEDs are connected in series to form an LED string. The constituent LEDs of an LED string thus share a common current.

In a large LCD matrix display, and in large solid state lighting applications, such as street lighting, typically the LEDs are supplied in a plurality of strings of serially connected LEDs, at least in part so that in the event of failure of one string at least some light is still output.

LEDs exhibit similar electrical characteristics to diodes, i.e. they only conduct current when the forward voltage across the device reaches its conduction threshold, denoted $V_f$. When the forward voltage rises above $V_f$ the current flowing through the device increases sharply. As a result, a constant current source is preferred for driving LEDs, typically implemented as a switching type DC to DC converter in current control mode.

LEDs providing high luminance exhibit a range of forward voltage drops, denoted $V_f$, and their luminance is primarily a function of current. For example, one manufacturer of LEDs suitable for use with a portable computer, such as a notebook computer, indicates that $V_f$ for a particular high luminance white LED ranges from 2.95 volts to 3.65 volts at 20 mA and an LED junction temperature of 25° C., thus exhibiting a variance in $V_f$ of greater than ±10%. Furthermore, the luminance of the LEDs vary as a function of junction temperature and age, typically exhibiting a reduced luminance as a function of current with increasing temperature and increasing age.

In order to provide a balanced overall luminance, it is important to control the current of the various LED strings to be approximately equal despite the disparate electrical characteristics of the various strings. In one embodiment a power source is supplied for each LED string, and the voltage of the power source is controlled in a closed loop to ensure that the voltage output of the power source is consonant with the voltage drop of the LED string, however the requirement for a power source for each LED string is quite costly.

In another embodiment, as described in U.S. Patent Application Publication US 2007/0195025 to Korcharz et al, entitled "Voltage Controlled Backlight Driver" and published Aug. 23, 2007, the entire contents of which is incorporated herein by reference, this is accomplished by a controlled dissipative element placed in series with each of the LED strings. In another embodiment, binning is required, in which LEDs are sorted, or binned, based on their electrical and optical characteristics. Thus, in order to operate a plurality of like colored LED strings from a single power source, at a common current, either binning of the LEDs to be within a predetermined range of $V_f$ is required, or a power regulation device, such as the dissipative element of the aforementioned patent application, must be supplied to drop the voltage difference between the strings caused by the differing $V_f$ values so as to produce an equal current through each of the LED strings. Either of these solutions adds to cost and/or wasted energy.

U.S. Pat. No. 7,242,147 issued Jul. 10, 2007 to Jin, entitled "Current Sharing Scheme for Multiple CCF Lamp Operation", the entire contents of which is incorporated herein by reference, is addressed to a balancer, wherein each CCFL is connected to an AC power source lead via a primary transformer winding. The secondary windings are connected in a closed in-phase loop. The balancer requires an alternating current input in order to avoid DC saturation of the transformers, and is thus not suitable for use with LED strings, which operate only on DC.

What is needed is a LED driving arrangement, preferably of low cost, which further provides appropriate balancing between the LED strings without excess power dissipation.

SUMMARY OF THE INVENTION

Accordingly, it is a principal object of the present invention to overcome at least some of the disadvantages of the prior art. This is provided in certain embodiments by a solid state lighting unit exhibiting a plurality of LED strings receiving power from a single power source, the single power source providing a discontinuous current. A plurality of first windings are provided, each associated with a particular LED string and coupled to provide current balancing between the various LED strings. The discontinuous current resets the windings during the off time or during a reversal period.

In one particular embodiment, a second winding is magnetically coupled to each of the first windings, and the second windings are connected in a closed in-phase loop. In another particular embodiment, at least two of the first windings are magnetically coupled to each other, thus ensuring a balance between current in each LED string.

In one particular embodiment, the power source is a boost converter and in another particular embodiment the power source is a flyback converter. In yet another particular embodiment the power source is an alternating current source.

In one particular embodiment the single power source is arranged to be driven with a balanced signal, such that the positive side and negative side are of equal energy over time.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
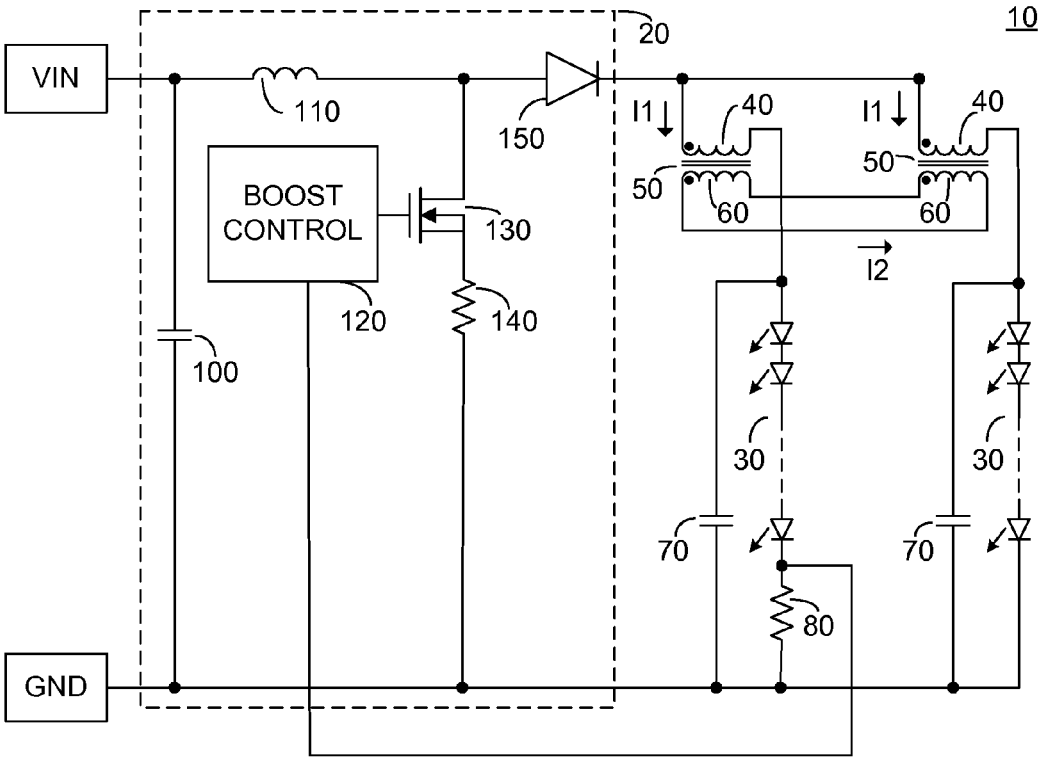
FIG. 1 illustrates a high level schematic diagram of an exemplary embodiment of a solid state lighting unit comprising a boost converter, wherein the series connected windings each represent a primary winding of a respective transformer, and the secondary windings are connected in a closed in-phase loop.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. The term winding is particularly meant to mean a winding of electrically conducting wire forming an inductor. The winding may form a stand alone inductor, or be magnetically coupled to another winding forming a transformer.

FIG. 1 illustrates a high level schematic diagram of an exemplary embodiment of a solid state lighting unit 10 comprising a boost converter 20, a plurality of LED strings 30 and a plurality of first windings 40, wherein first windings 40 each represent a primary winding of a respective balancer transformer 50, each respective balancer transformer 50 exhibiting a magnetically coupled secondary winding 60, and the secondary windings 60 are connected in a closed in-phase loop, as will be described further hereinto below. Solid state lighting unit 10 further comprises a plurality of capacitors 70, each associated with a particular one of LED strings 30, and a sense resistor 80. Only a single sense resistor 80 is shown, however a plurality of sense resistors 80 may be supplied without exceeding the scope.

Boost converter 20 comprises: an input capacitor 100; a storage inductor 110; a control circuit 120; an electronically controlled switch 130, illustrated without limitation as an NMOSFET; a resistor 140; and a unidirectional electronic valve 150, illustrated without limitation as a diode.

An input DC voltage potential, denoted VIN is connected to a first end of input capacitor 100 and to a first end of storage inductor 110. A second end of storage inductor 110 is connected to one terminal of electronically controlled switch 130, particularly the drain terminal thereof, and to the anode of unidirectional electronic valve 150. The gate terminal of electronically controlled switch 130 is connected to the output of control circuit 120, and the source terminal of electronically controlled switch 130 is connected to a common potential point, denoted GND, via resistor 140. The second end of input capacitor 100 is connected to the common potential point.

The cathode of unidirectional electronic valve 150 is connected in parallel to a first end of each first winding 40, and the second end of each first winding 40 is connected to the anode end of a respective LED string 30, and to a first end of the respective associated capacitor 70. The cathode end of a particular one of the LED strings 30 is connected to a first end of sense resistor 80 and to the input of control circuit 120. The second end of sense resistor 80 and the cathode end of the remainder of the LED strings 30 are connected to the common potential point. The second end of each capacitor 70 is connected to the common potential point.

As indicated above each first winding 40 is magnetically coupled with a particular secondary winding 60 thus forming a balancer transformer 50. Secondary windings 60 are connected in a closed serial in-phase loop, thus ensuring that a common current flows through all of the secondary windings 60 in a uniform direction when current flows through LED strings 30. A current I1 is illustrated entering the first end of first winding 40 and a common current I2 is illustrated flowing through the secondary windings 60.

Only two transformers 50 and LED strings 30 are shown for clarity however this is not meant to be limiting in any way. Additional transformers and LED strings 30 may be connected in parallel, with secondary windings 60 connected to form a single in-phase loop without exceeding the scope.

In operation, when electronically controlled switch 130 is closed inductive current builds up in storage inductor 110, and when electronically controlled switch 130 is opened the inductive current continues to flow through storage inductor 110 and freewheels to LED strings 30 through diode 150 and the respective first windings 40. The amount of current flowing through the LED strings 30 is sensed by a voltage drop developed across sense resistor 80 and control circuit 120 thus varies the duty cycle of electronically controlled switch 130 to ensure that the current flowing through LED strings 30 is consonant with a reference target. Capacitors 70 provide filtering of the ripple developed across LED strings 30.

As described above there is a difference between the voltage drop across each of the LED strings 30, and thus the current through the various LED strings 30 will tend to be different accordingly. Advantageously, due to the closed in-phase loop of secondary windings 60, the electro-magnetic coupling mechanism of each of the respective transformers 50 will generate a correction voltage in the respective primary winding 40 to compensate for the LED voltage difference and force current through the various LED strings 30 to be equal. Such balancing action can be explained by an equation of each balancer transformer 50:

$$N1\int I1\,dt = N2\int I2\,dt \qquad \text{EQ. 1}$$

where, N1 represents the number of turns of the respective primary winding 40, N2 represents the number of turns of the respective secondary winding 60, I1 represents the current through the respective primary winding 40, as indicated above, and I2 represents the current through the respective secondary winding 60, as indicated above.

Because current I2 in secondary windings 60 are all equal due to the closed in-phase loop, the primary current I1 flowing through each LED string 30 tends to be equal when all the transformers have the same turns ratio.

Because of the tolerance of the voltage drops across the various LED strings 30, the voltage across each balancer transformer 50 primary winding 40 will be different when primary current I1 is flowing. Such voltage difference will cause a small balancing error in each switching cycle, and if such an error is accumulated over multiple operating cycles, it could result in a large DC bias error and eventually drive the current through the respective LED string 30 out of the specification range. In order to prevent such situation, reset of the balancer current through the transformers 50 and the respective balancer core flux has to occur periodically. Advantageously, the discontinuous output of boost converter 20 provides such a reset time in each operating cycle, particularly since no output capacitor is supplied for boost converter 20. In further detail, when electronically controlled switch 130 is closed, unidirectional electronic valve 150 is reverse biased and no current is driven into the respective first windings 40, thus providing a reset for the transformer core. The small energy stored in the primary leakage inductance of transformers 50 quickly decays to zero by freewheeling through the path of LED string 30, resistor 140 if present, closed electronically controlled switch 130 and via diode 150 returning to primary winding 40.

Figure 2:
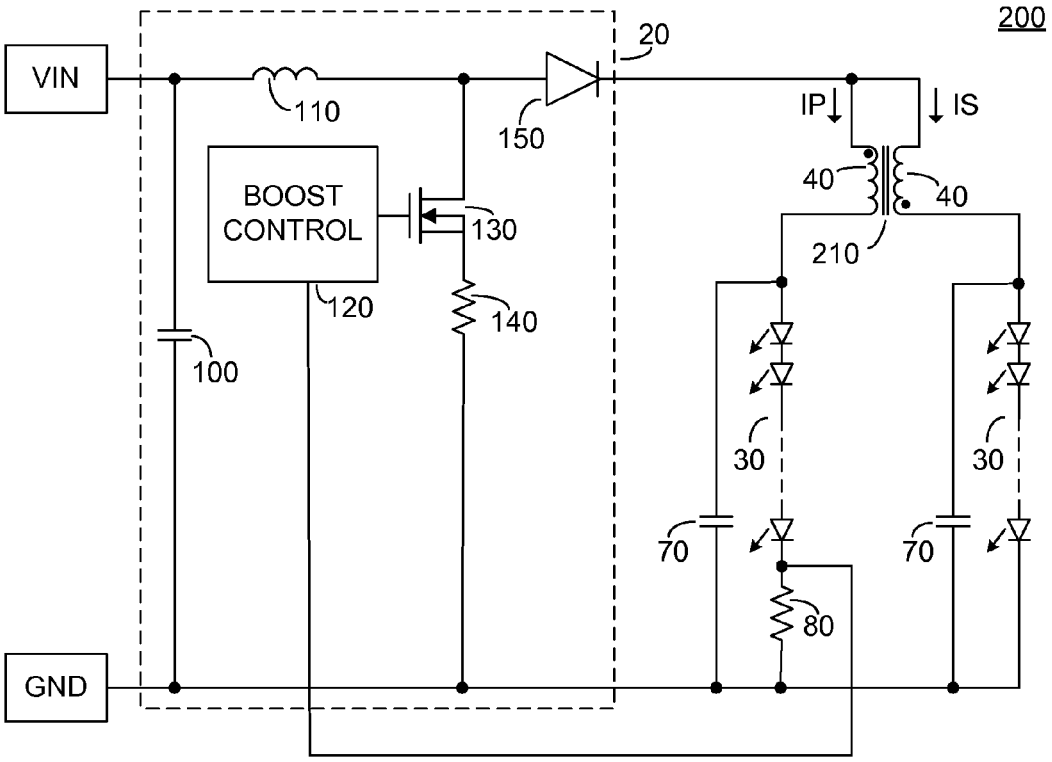
FIG. 2 illustrates a high level schematic diagram of an exemplary embodiment of a solid state lighting unit comprising a boost converter, wherein the series connected windings are magnetically coupled to each other.

FIG. 2 illustrates a high level schematic diagram of an exemplary embodiment of a solid state lighting unit 200 comprising a boost converter 20, a pair of LED strings 30, and a pair of first windings 40 magnetically coupled so as to form a balancer transformer 210. Solid state lighting unit 200 further comprises a plurality of capacitors 70, each associated with a particular one of LED strings 30, and a sense resistor 80. Only a single sense resistor 80 is shown, however a plurality of sense resistors may be supplied without exceeding the scope.

Boost converter 20 comprises: an input capacitor 100; a storage inductor 110; a control circuit 120; an electronically controlled switch 130, illustrated without limitation as an NMOSFET; a resistor 140; and a unidirectional electronic valve 150, illustrated without limitation as a diode.

An input DC voltage potential, denoted VIN is connected to a first end of input capacitor 100 and to a first end of storage inductor 110. A second end of storage inductor 110 is connected to one terminal of electronically controlled switch 130, particularly the drain terminal thereof, and to the anode of unidirectional electronic valve 150. The gate terminal of electronically controlled switch 130 is connected to the output of control circuit 120, and the source terminal of electronically controlled switch 130 is connected to a common potential point, denoted GND, via resistor 140. The second end of input capacitor 100 is connected to the common potential point.

The cathode of diode 150 is connected in parallel to a first end of each first winding 40, and the second end of each first winding 40 is connected to the anode end of a respective LED string 30, and to a first end of the respective associated capacitor 70. The cathode end of a particular one of the LED strings 30 is connected to a first end of sense resistor 80 and to the input of control circuit 120. The second end of sense resistor 80 and the cathode end of the remaining LED strings 30 are connected to the common potential point. The second end of each capacitor 70 is connected to the common potential point.

A current IP is illustrated entering the first end of a first winding 40 and a current IS is illustrated entering the first end of a second first winding 40. The connection polarity is shown such that the fluxes generated by the current of the first windings 40 cancel each other.

In operation, as described above in relation to EQ. 1 the currents of the two LED strings, IS and IP are forced to be equal as long as the turns ratio of balancer transformer 210 is 1:1. Reset of the flux of balancer transformer 210 is provided during the time that electronically controlled switch 130 is closed, which thus prevents DC bias current accumulation over time. While only two LED strings 30 are shown, this is not meant to be limiting in any way, and such a balancing network can be further extended to more LED branches by cascading the balancing network configuration, i.e. each first winding 40 of balancer transformer 210 may be further connected to an additional balancer transformer 210 driving an additional pair of LED strings 30. Because the losses in balancer transformer 210 are very low, such a balancing method provides a non-dissipative type of LED current matching, yielding a low cost and high efficiency LED drive system.

Figure 3:
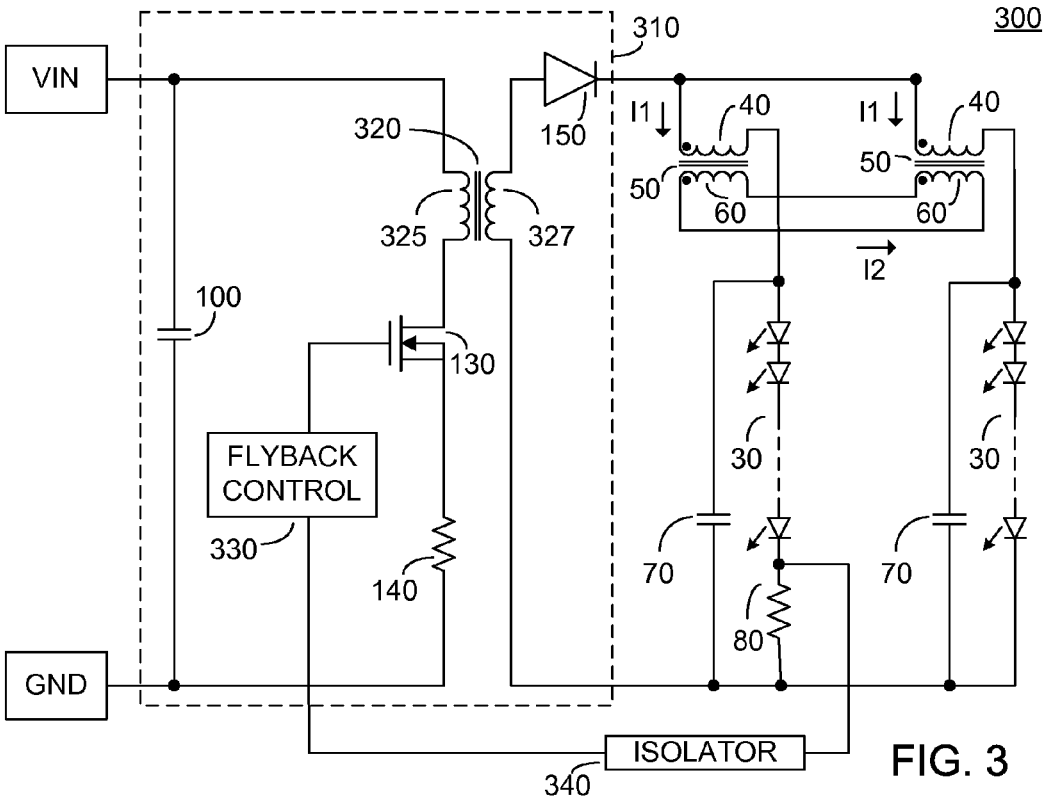
FIG. 3 illustrates a high level schematic diagram of an exemplary embodiment of a solid state lighting unit comprising a flyback converter, wherein the series connected windings each represent a primary winding of a respective transformer, and the secondary windings are connected in a closed in-phase loop.

FIG. 3 illustrates a high level schematic diagram of an exemplary embodiment of a solid state lighting unit 300 comprising a flyback converter 310, an isolator 340, a plurality of LED strings 30 and a plurality of first windings 40, wherein first windings 40 each represent a primary winding of a respective balancer transformer 50, each balancer transformer 50 exhibiting a magnetically coupled secondary winding 60, and the secondary windings 60 are connected in a closed in-phase loop, as described above in relation to solid state lighting unit 10. Solid state lighting unit 300 further comprises a plurality of capacitors 70, each associated with a particular one of LED strings 30, and a sense resistor 80. Only a single sense resistor 80 is shown, however a plurality of sense resistors may be supplied without exceeding the scope. Isolator 340 may comprise an opto-isolator or transformer without limitation.

Flyback converter 310 comprises: an input capacitor 100; a transformer 320; a flyback control circuit 330; an electronically controlled switch 130, illustrated without limitation as an NMOSFET; a resistor 140; and a unidirectional electronic valve 150, illustrated without limitation as a diode.

An input DC voltage potential, denoted VIN is connected to a first end of input capacitor 100 and to a first end of a first winding 325 of transformer 320. A second end of first winding 325 of transformer 320 is connected to one terminal of electronically controlled switch 130, particularly the drain terminal thereof. The gate terminal of electronically controlled switch 130 is connected to the output of flyback control circuit 330, and the source terminal of electronically controlled switch 130 is connected to a common potential point, denoted GND, via resistor 140. A second end of input capacitor 100 is connected to the common point.

A first end of a second winding 327 of transformer 320 is connected to the anode of unidirectional electronic valve 150, and the second end of second winding 327 of transformer 320 is connected to a second common potential point, typically isolated from GND. The cathode of unidirectional electronic valve 150 is connected in parallel to a first end of each first winding 40, and the second end of each first winding 40 is connected to the anode end of a respective LED string 30, and to a first end of the respective associated capacitor 70. The cathode end of a particular one of the LED strings 30 is connected to a first end of sense resistor 80 and to the input of flyback control circuit 330 via isolator 340. The second end of sense resistor 80 and the cathode end of the remainder of the LED strings 30 are connected to the second common potential point. The second end of each capacitor 70 is connected to the second common potential point.

As indicated above each first winding 40 is magnetically coupled with a particular secondary winding 60 thus forming a balancer transformer 50. Secondary windings 60 are connected in a closed serial in-phase loop, thus ensuring that a common current flows through all of the secondary windings 60 in a uniform direction when current flows through LED strings 30. A current I1 is illustrated entering the first end of each first winding 40 and a common current I2 is illustrated flowing through the in-phase loop of secondary windings 60.

Only two balancer transformers 50 and LED strings 30 are shown for clarity however this is not meant to be limiting in any way. Additional balancer transformers 50 and LED strings 30 may be connected in parallel, with secondary windings 60 of all balancer transformers 50 connected to form a single in-phase loop without exceeding the scope.

In operation, solid state lighting unit 300 operates in all respects similar to that of solid state lighting unit 10, with the exception that the power is supplied by flyback converter 310 instead of boost converter 20. During the period when electronically controlled switch 130 is open the energy stored in first winding 325 of transformer 320 flies back to LED strings 30 via second winding 327 of transformer 320 and the LED current is forced to be equal by the balancer network composed of transformers 50 whose secondary windings 60 are connected in a closed in-phase loop. When electronically controlled switch 130 is closed the inductive current of first winding 325 of transformer 320 builds up and the current through balancing transformers 50 extinguishes thus resetting the core of each balancer transformer 50, as described above in relation to FIG. 1.

Figure 4:
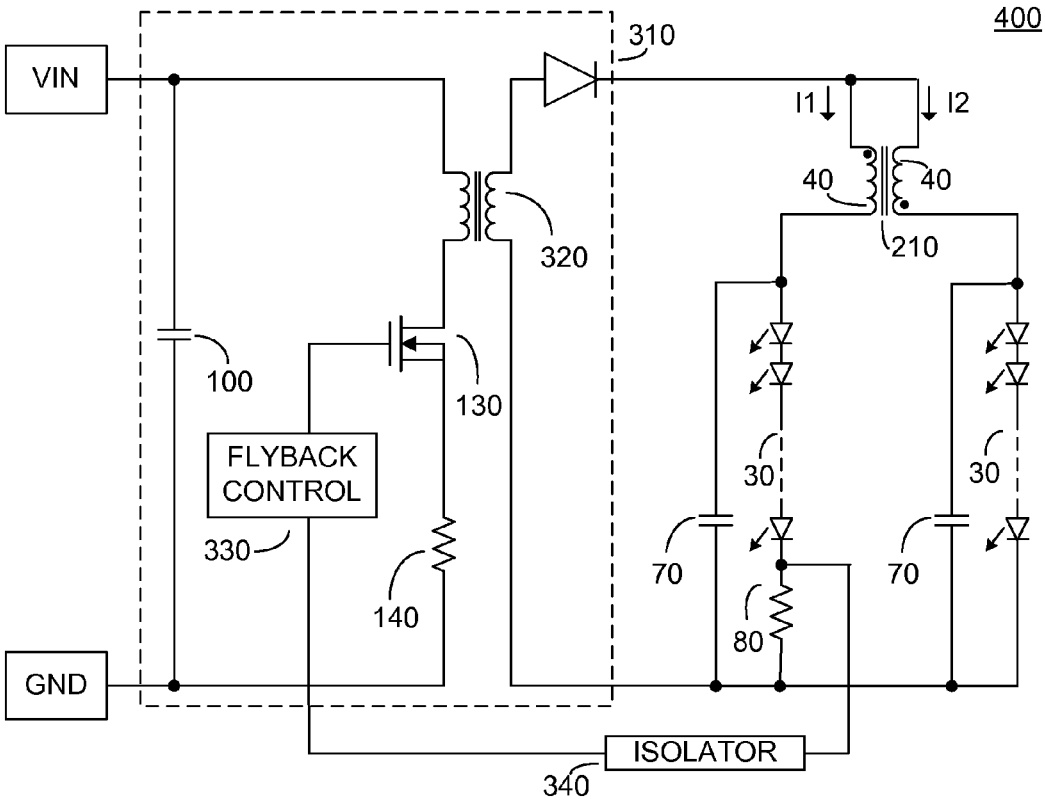
FIG. 4 illustrates a high level schematic diagram of an exemplary embodiment of a solid state lighting unit comprising a flyback converter, wherein the series connected windings are magnetically coupled to each other.

FIG. 4 illustrates a high level schematic diagram of an exemplary embodiment of a solid state lighting unit 400 comprising a flyback converter 310, wherein the series connected windings 40 are magnetically coupled to each other to form balancer transformer 210, as described above in relation to solid state lighting unit 200 of FIG. 2. In operation, power is supplied as described above in relation to solid state lighting unit 300 of FIG. 3 and balancing between the LED strings 30 is provided as described above in relation to solid state lighting unit 200.

Figure 5:
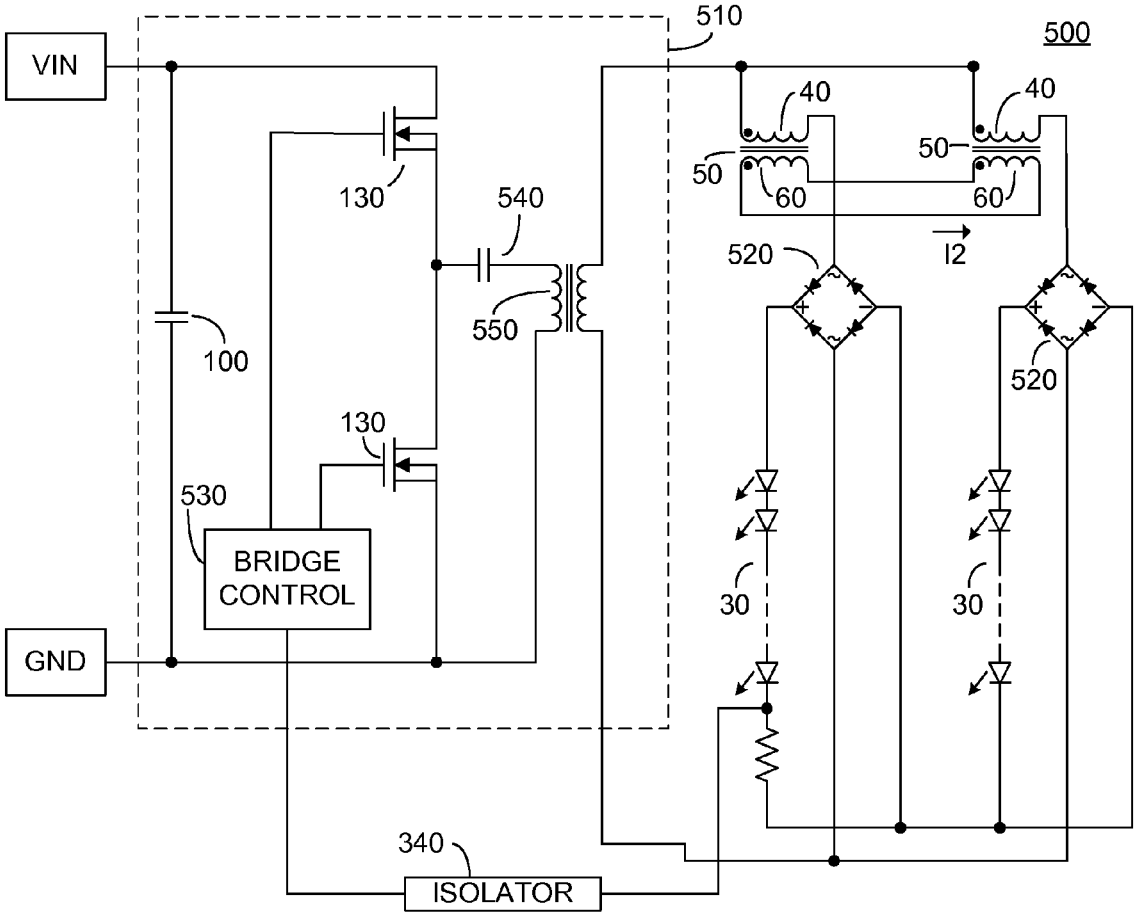
FIG. 5 illustrates a high level schematic diagram of a first exemplary embodiment of a solid state lighting arrangement driven by an AC signal, wherein the series connected windings each represent a primary winding of a respective transformer, and the secondary windings are connected in a closed in-phase loop.

FIG. 5 illustrates a high level schematic diagram of an exemplary embodiment of a solid state lighting unit 500 comprising a bridge circuit 510, an isolator 340, a plurality of LED strings 30 and a plurality of first windings 40, wherein first windings 40 each represent a primary winding of a respective balancer transformer 50, each balancer transformer 50 exhibiting a magnetically coupled secondary winding 60, and the secondary windings 60 are connected in a closed in-phase loop, as described above in relation to solid state lighting unit 10 of FIG. 1 and solid state lighting unit 300 of FIG. 3, and wherein a full wave rectifier 520 is provided for each LED string 30.

Bridge circuit 510 comprises: an input capacitor 100; a first and a second electronically controlled switch 130, each illustrated without limitation as an NMOSFET; a bridge control circuit 530; an isolation capacitor 540; and a power transformer 550. An input DC voltage potential, denoted VIN, is connected to a first end of input capacitor 100 and to a first terminal of first electronically controlled switch 130, specifically the drain of electronically controlled switch 130. The source of first electronically controlled switch 130 is connected to a first terminal of second electronically controlled switch 130, specifically the drain thereof, and to a first end of isolation capacitor 540. The second end of input capacitor 100 and the source of second electronically controlled switch 130 are connected to a common potential point, denoted GND. The second end of isolation capacitor 540 is connected to a first end of a first winding of power transformer 550 and a second end of the first winding of power transformer 550 is connected to the common potential point. The outputs of bridge control circuit 530 are connected to respective gates of first and second electronically controlled switches 130.

A first end of a second winding of power transformer 550 is connected to a first end of each first winding 40, and the second end of each first winding 40 is connected to a first alternating current input of a respective full wave rectifier 520. The positive full wave rectified output terminal of each full wave rectifier 520 is connected to the anode end of the respective LED string 30. A second alternating current input of each full wave rectifier 520 is connected to the second end of the second winding of power transformer 550, and the negative full wave rectified output terminal of each full wave rectifier 520 is connected to a second common potential point, typically isolated from GND. The balance of the connections of solid state lighting unit 500 are as described above in relation to solid state lighting arrangement 300 of FIG. 3, and in the interest of brevity will not be further described.

In operation, bridge circuit 510 provides an AC voltage via power transformer 550. Full wave rectifiers 520 ensure that current flows through LED strings 30 during each half of the AC cycle. The current of the LED strings 30 are balanced by the balancer network comprised of transformers 50, as described above in relation to solid state lighting unit 10 and solid state lighting unit 300. Isolation capacitor 540 further ensures that on average the amount of current passing through the various LED strings 30 is the same for each half cycle, since any mismatch between the consecutive half cycles will result in a residual voltage on isolation capacitor 540. Similarly the balancing arrangement of solid state lighting units 200 and 400 of FIGS. 2 and 4, respectively, may be utilized without exceeding the scope. Bridge circuit 510 is illustrated as a half bridge network, however this is not meant to be limiting in any way, and other topologies such as a full bridge or push-pull circuit may be substituted for bridge circuit 510 without exceeding the scope.

Figure 6:
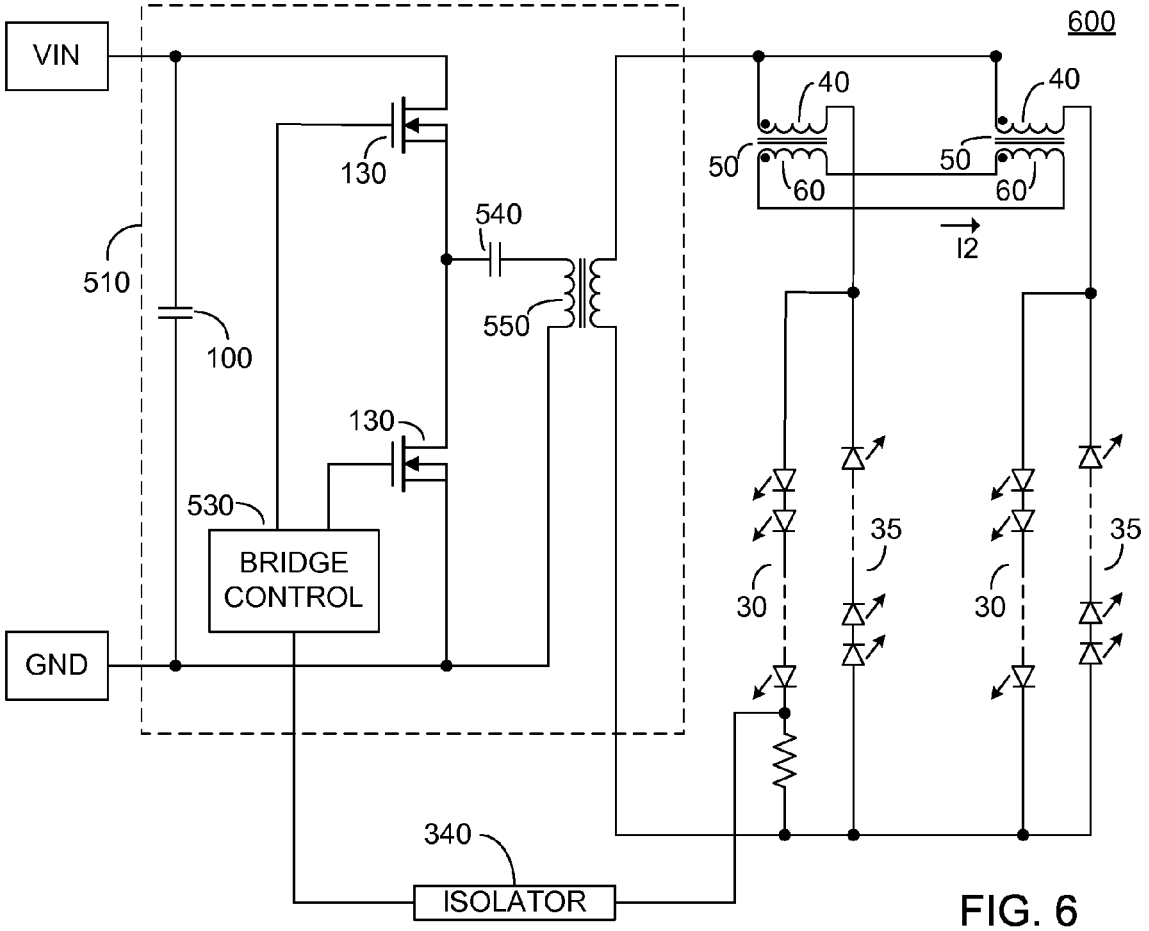
FIG. 6 illustrates a high level schematic diagram of a second exemplary embodiment of a solid state lighting arrangement driven by an AC signal, wherein the series connected windings each represent a primary winding of a respective transformer and the secondary windings are connected in a closed in-phase loop.

FIG. 6 illustrates a high level schematic diagram of an exemplary embodiment of a solid state lighting unit 600. The arrangement and operation of solid state lighting unit 600 is in all respects similar to the construction and operation of solid state lighting unit 500 of FIG. 5, except that instead of full wave rectifiers 520 supplying DC power to LED strings 30, an additional LED string 35 is provided in anti-parallel with the each LED string 30, with the cathode end of the respective LED string 35 connected to the anode end of the respective LED string 30 and the anode end of the respective LED string 35 connected to the second common point. During a first phase of the AC power output by bridge circuit 510 current is supplied to LED strings 30 and during a second phase of the AC power, opposing the first phase, current is supplied to LED strings 35. The current of LED strings 30 and 35 are balanced by the balancer network comprised of transformers 50, as described above in relation to solid stage lighting unit 10 and solid state lighting unit 300.

Figure 7:
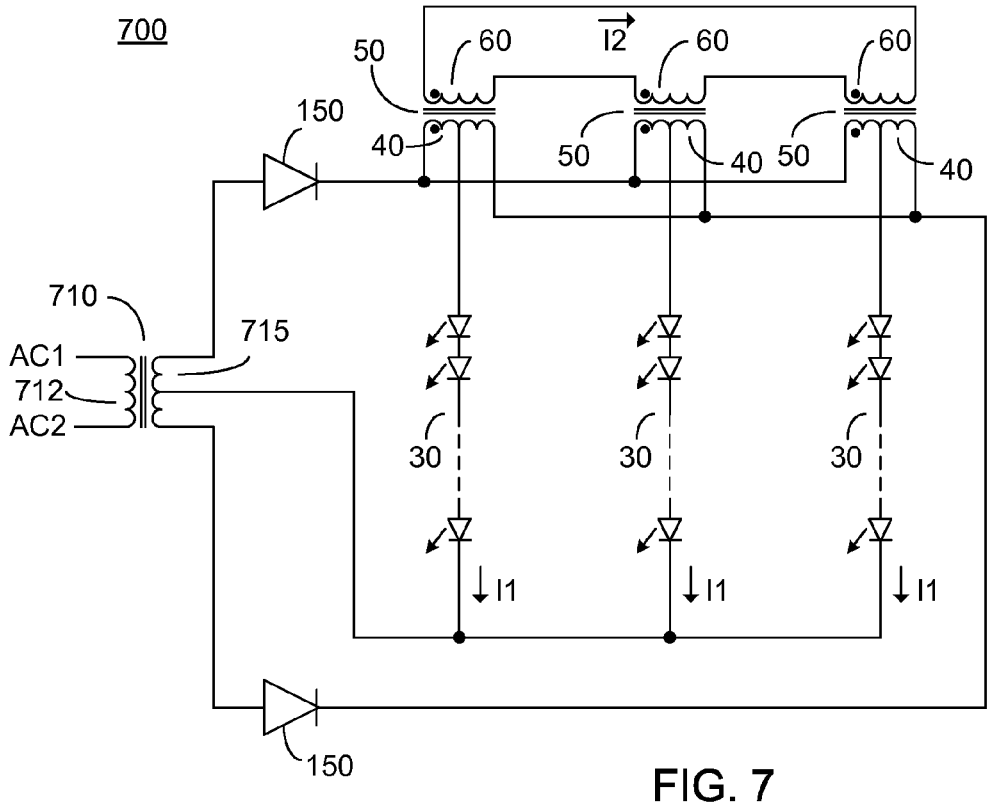
FIG. 7 illustrates a high level schematic diagram of a first exemplary embodiment of a solid state lighting arrangement driven by an AC signal, wherein each of the LED strings are driven on each half cycle through an associated portion of the primary winding of a respective transformer and the secondary windings are connected in a closed in-phase loop.

FIG. 7 illustrates a high level schematic diagram of a first exemplary embodiment of a solid state lighting arrangement 700 driven by AC signal, wherein each of a plurality of LED strings 30 are driven on each half cycle through an associated portion of the primary winding of a respective transformer and the secondary windings are connected in a closed in-phase loop. In particular, solid state lighting arrangement 700 comprises: a driving transformer 710 comprising a primary winding 712 magnetically coupled to a secondary winding 715; a plurality of unidirectional electronic valves 150, each illustrated without limitation as a diode; a plurality of balancer transformers 50 each comprising a first winding 40 and a second winding 60; and a plurality of LED strings 30. Each balancer transformer 50 is associated with a particular LED string 30.

Primary winding 712 of driving transformer 710 is connected to an AC source, which may be in all respects similar to bridge circuit 510 of solid stage lighting arrangement 500, without limitation. A first end of primary winding 712 is connected to a first polarity of the AC source, denoted AC1, and a second end of primary winding 712 is connected to an opposing polarity of the AC source, denoted AC2. A first end of secondary winding 715 is connected to the anode of a first unidirectional electronic valve 150, and the cathode of the first unidirectional electronic valve 150 is connected to a first end of first winding 40 of each balancer transformer 50. The second end of first winding 40 of each balancer transformer 50 is connected to the cathode of a second unidirectional electronic valve 150 and the anode of the second unidirectional electronic valve 150 is connected to a second end of second winding 715.

The anode end of each LED string 30 is connected to a center tap of first winding 40 of the respective associated balancer transformer 50, and the cathode end of each LED string 30 is connected to a center tap of secondary winding 715 of driving transformer 710. A sense resistor may be supplied, as described above in relation to solid state lighting arrangement 10, with or without isolation, without exceeding the scope. A capacitor may be supplied (not shown) in parallel with each LED string 30 to smooth out any ripple current without exceeding the scope.

As indicated above each first winding 40 is magnetically coupled with a particular secondary winding 60 thus forming a balancer transformer 50. Secondary windings 60 are connected in a closed serial in-phase loop, thus ensuring that a common current, illustrated as current I2, flows through all of the secondary windings 60 in a uniform direction when current flows through LED strings 30. A current I1 is illustrated flowing through each LED string 30.

Three LED strings 30 and the associated balancer transformers 50 are shown for clarity however this is not meant to be limiting in any way. Additional transformers 50 and LED strings 30 may be connected in parallel, with all of the secondary windings 60 connected to form a single in-phase loop without exceeding the scope.

In operation, when the first end of secondary winding 715 is positive in relation to the second end of secondary winding 715, current I1 is supplied to each of the LED strings 30 through the first unidirectional electronic valve 150 and the respective half of first winding 40 of balancer transformer 50. Current I1 flows only through the first half of first winding 40, i.e. from the first end of first winding 40 to the center tap, and is returned to the center tap connection of secondary winding 715. Current I1 through each of the LED strings 30 is balanced by the operation of the single in-phase loop of secondary windings 60, with the polarity of I2 as illustrated.

When the second end of secondary winding 715 is positive in relation to the first end of secondary winding 715, current I1 is supplied to each of the LED strings 30 through the second unidirectional electronic valve 150 and the respective second half of first winding 40 of balancer transformer 50. Current I1 flows only through the second half of first winding 40, i.e. from the second end of first winding 40 to the center tap. Current I1 through each of the LED strings 30 is balanced by the operation of the single in-phase loop of secondary windings 60, where current I2 is in the reverse polarity (not shown). Resetting of each of the balancer transformers 50 occurs due to the flux reversal between the two half AC cycles.

Figure 8:
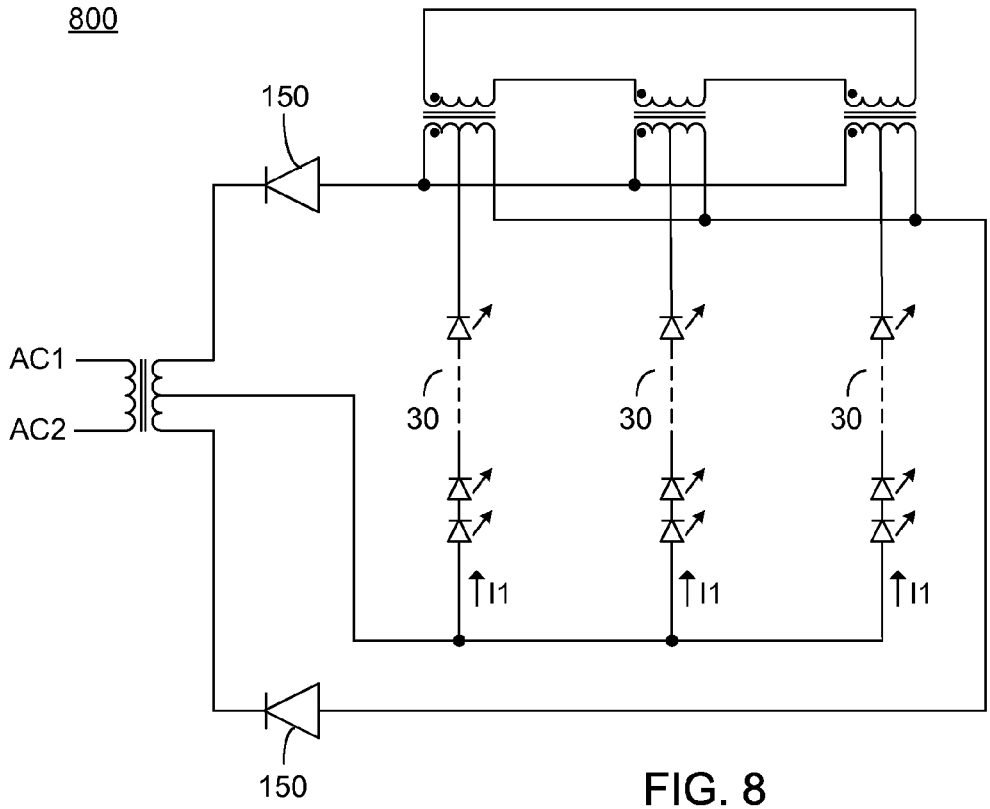
FIG. 8 illustrates a high level schematic diagram of a second exemplary embodiment of a solid state lighting arrangement driven by an AC signal, wherein each of the LED strings are driven on each half cycle through an associated portion of the primary winding of a respective transformer and the secondary windings are connected in a closed in-phase loop.

FIG. 8 illustrates a high level schematic diagram of a second exemplary embodiment of a solid state lighting arrangement 800 driven by AC signal, wherein each of a plurality of LED strings 30 are driven on each half cycle through an associated portion of the primary winding of a respective transformer and the secondary windings are connected in a closed in-phase loop. Solid state lighting arrangement 800 is in all respects similar to solid state lighting arrangement 700 with the exception that the polarity of the unidirectional electronic valves 150 are reversed and the polarity of the LED strings 30 are similarly reversed, with current flow I1 reversed as illustrated.

Figure 9:
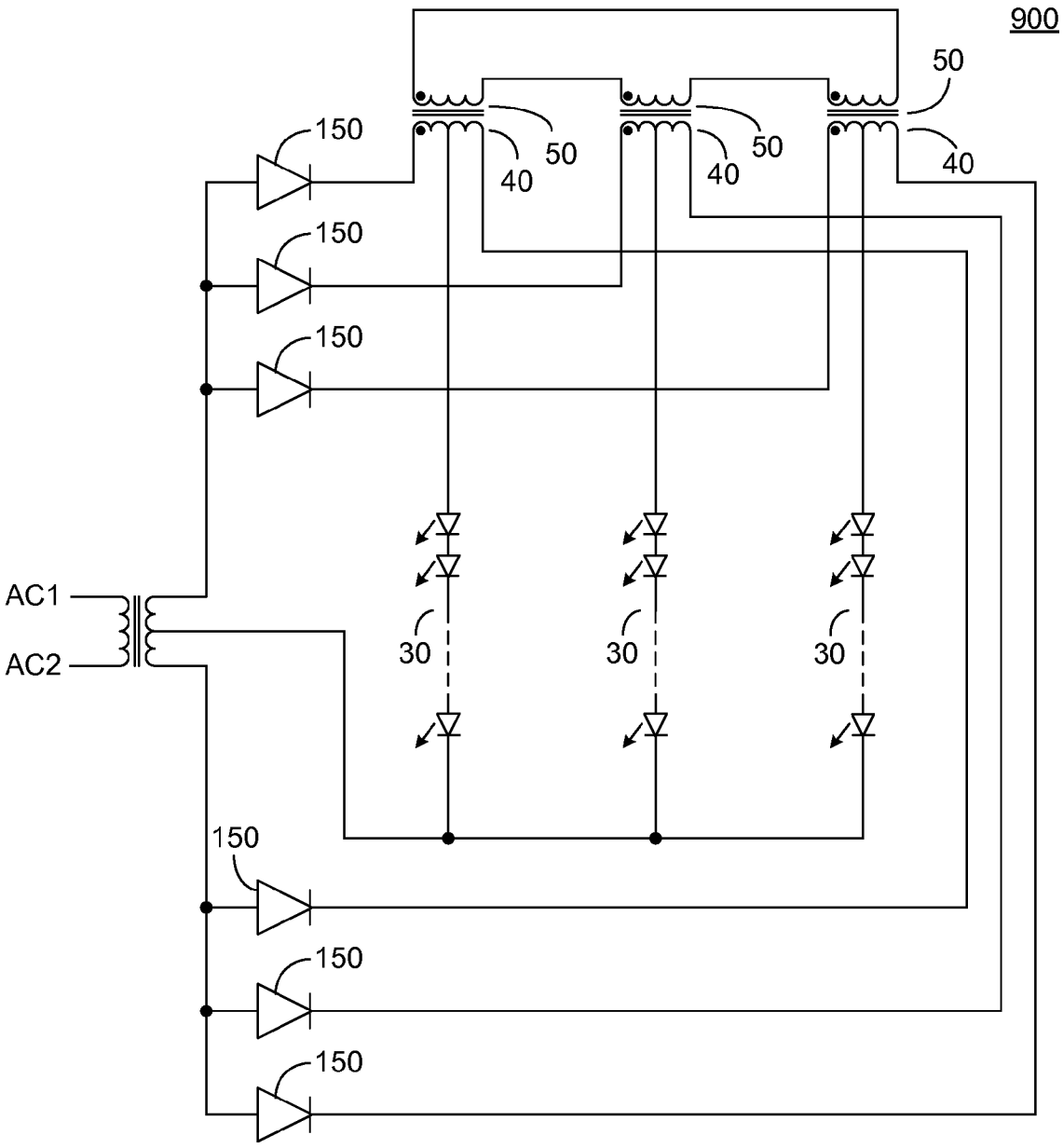
FIG. 9 illustrates a high level schematic diagram of a third exemplary embodiment of a solid state lighting arrangement driven by an AC signal, wherein each of the LED strings are driven on each half cycle through an associated portion of the primary winding of a respective transformer and the secondary windings are connected in a closed in-phase loop.

FIG. 9 illustrates a high level schematic diagram of a third exemplary embodiment of a solid state lighting arrangement 900 driven by AC signal, wherein each of a plurality of LED strings 30 are driven on each half cycle through an associated portion of the primary winding 40 of a respective balancer transformer 50 and the secondary windings 60 are connected in a closed in-phase loop. Solid state lighting arrangement 900 is in all respects similar to solid state lighting arrangement 700 with the exception that a separate pair of unidirectional electronic valves 150 is supplied for each first winding 40. The polarity of unidirectional electronic valves 150 and LED strings 30 of solid state lighting arrangement 900 can be reversed, as described above in relation to solid state lighting arrangement 800, and still offer the same balanced LED drive performance. In such a reversed case the current flowing through LED strings 30 takes the opposite path through the primary winding 40 of the balancer transformer 50 during the respective first and second half cycle of the AC signal as compared with the current flow of solid state lighting arrangement 900.

Figure 10:
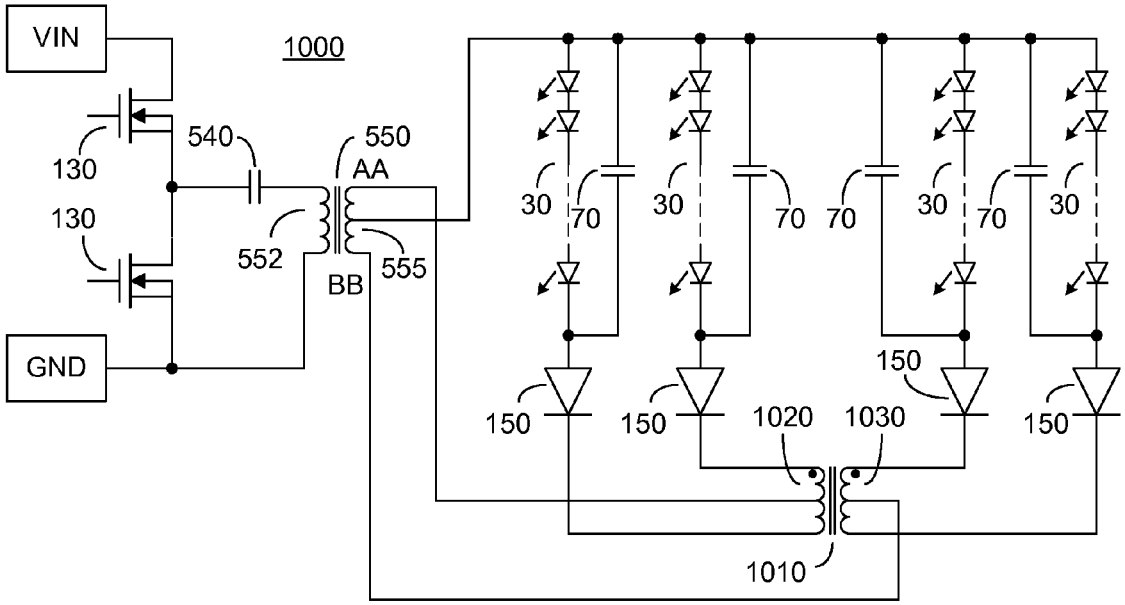
FIG. 10 illustrates a high level schematic diagram of an exemplary embodiment of a solid state lighting arrangement comprising 4 LED strings with a single balancing transformer.

FIG. 10 illustrates a high level schematic diagram of an exemplary embodiment of a solid state lighting arrangement 1000 comprising: a first and a second electronically controlled switch 130, illustrated without limitation as NMOSFETs; an isolating capacitor 540; a power transformer 550 having a primary winding 552 and a secondary winding 555; 4 LED strings 30 each with an associated capacitor 70 and an associated unidirectional electronic valve 150, illustrated without limitation as a diode; and a balancer transformer 1010 comprising a first winding 1020 and a second winding 1030. Preferably first winding 1020 and second winding 1030 have an equal number of turns. Electronically controlled switches 130 are preferably part of a half bridge switching arrangement, as described above in relation to FIG. 5, and for clarity both VIN and GND are shown. While a half bridge driver is illustrated, other converter circuits, including without limitation a full bridge, may be provided without exceeding the scope.

The drain of first electronically controlled switch 130 is connected to VIN and the source of second electronically controlled switch 130 is connected to GND. The source of first electronically controlled switch 130 is connected to the drain of second electronically controlled switch 130 and to a first end of isolating capacitor 540. A second end of isolating capacitor 540 is connected to a first end of primary winding 552, and a second end of primary winding 552 is connected to GND.

A first end of secondary winding 555, denoted AA, is connected to the center tap of first winding 1020 of balancer transformer 1010 and a second end of secondary winding 555, denoted BB is connected to the center tap of second winding 1030 of balancer transformer 1010. The center tap of secondary winding 555 is connected to the anode end of each LED string 30 and to a first end of each capacitor 70. The cathode end of each LED string 30 is connected to a second end of the respective associated capacitor 70 and to the anode of the respective associated unidirectional electronic valve 150. The cathode of each unidirectional electronic valve 150 is connected to a respective end of one of first and second windings 1020, 1030. In further detail, the cathode of a first unidirectional electronic valve 150 is connected to a first end of first winding 1020, denoted with a dot for polarity, the cathode of a second unidirectional electronic valve 150 is connected to a second end of first winding 1020, the cathode of a third unidirectional electronic valve 150 is connected to a first end of second winding 1030, denoted with a dot for polarity, and the cathode of a fourth unidirectional electronic valve 150 is connected to a second end of second winding 1030.

In operation, the LED strings 30 connected to the respective ends of first winding 1020 conduct in a half cycle when first end AA of secondary winding 555 is positive in relation to second end BB of secondary winding 555 and the LED strings 30 connected to second winding 1030 conduct in a half cycle when second end BB of secondary winding 555 is positive in relation to first end AA of secondary winding 555. The currents of the LED strings 30 connected to the respective ends of first winding 1020 are forced to be equal during the respective half cycle since the windings halves are magnetically coupled. Similarly, the currents of the LED strings 30 connected to the respective ends of second winding 1030 are forced to be equal during the respective half cycle since the windings halves are magnetically coupled.

As described above, isolating capacitor 540 is coupled in series with primary winding 552 of power transformer 550, and thus the current flowing through primary winding 552, and hence transferred to secondary winding 555 during the two half cycles will be equal, because isolating capacitor 540 does not couple DC current in steady state. If a difference in average operating voltage between the LED strings 30 during the respective half cycles exists, a DC bias will automatically develop across isolating capacitor 540 to offset the average operating voltage difference so as to maintain equal total current of the two LED string 30 groups, i.e. the LED strings 30 connected to respective ends of first winding 1020 and the LED strings connected to respective ends of second winding 1030. Thus, current through the two LED strings operative on each half cycle are balanced by the respective winding of balancer transformer 1010 and current between the half cycles are balanced by the operation of isolating capacitor 540.

Capacitors 70 are connected in parallel with each of the respective LED strings 30 to smooth out any ripple current and maintain the current through the respective LED string 30 to be approximately constant. Unidirectional electronic valves 150 are arranged to block any reverse voltage to LED strings 130 and further prevent bleeding of current between capacitors 70, particularly between capacitors 70 connected to the same winding.

Figure 11:
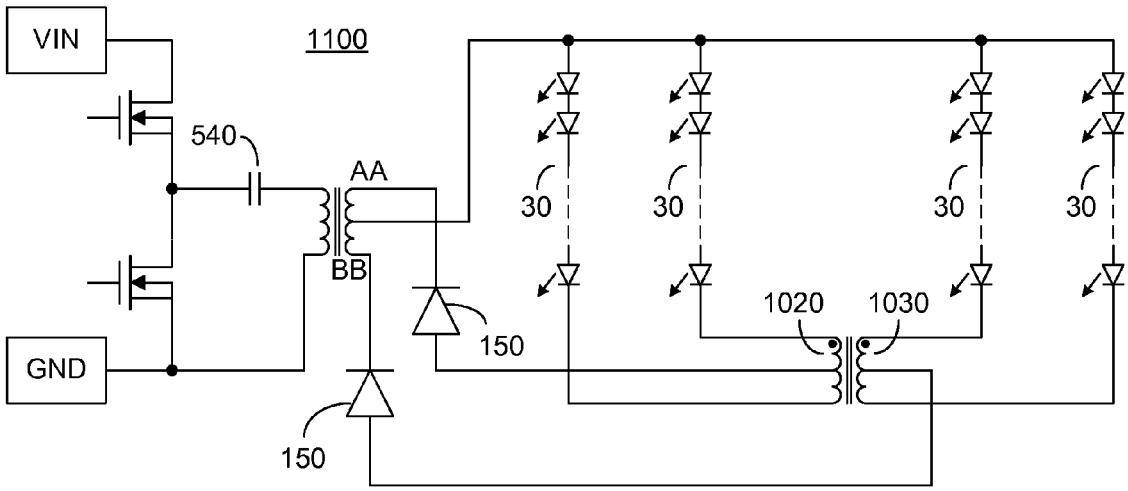
FIG. 11 illustrates the circuit architecture of FIG. 10, wherein an increased ripple is provided for the 4 balanced LED strings.

FIG. 11 illustrates a high level schematic diagram of an exemplary embodiment of a solid state lighting arrangement 1100, which is in all respects identical with solid state lighting arrangement 1000 with the exception that capacitors 70 are not provided, and thus LED strings 30 are allowed to operate with an increase amount of ripple current. Advantageously, in the absence of capacitors 70 first and second unidirectional electronic valves 150 which were connected between the respective ends of first winding 1020 and the cathode end of the respective LED string 30 are merged into a single unidirectional electronic valve 150 connected between the center tap of first winding 1020 and first end AA of secondary winding 555. Similarly, third and fourth unidirectional electronic valves 150 which were connected between the respective ends of second winding 1030 and the cathode end of the respective LED string 30 are merged into a single unidirectional electronic valve 150 connected between the center tap of second winding 1030 and second end BB of secondary winding 555. Operation of lighting arrangement 1100 is in all respects similar to the operation of lighting arrangement 1000, and in the interest of brevity will not be further detailed.

Figure 12:
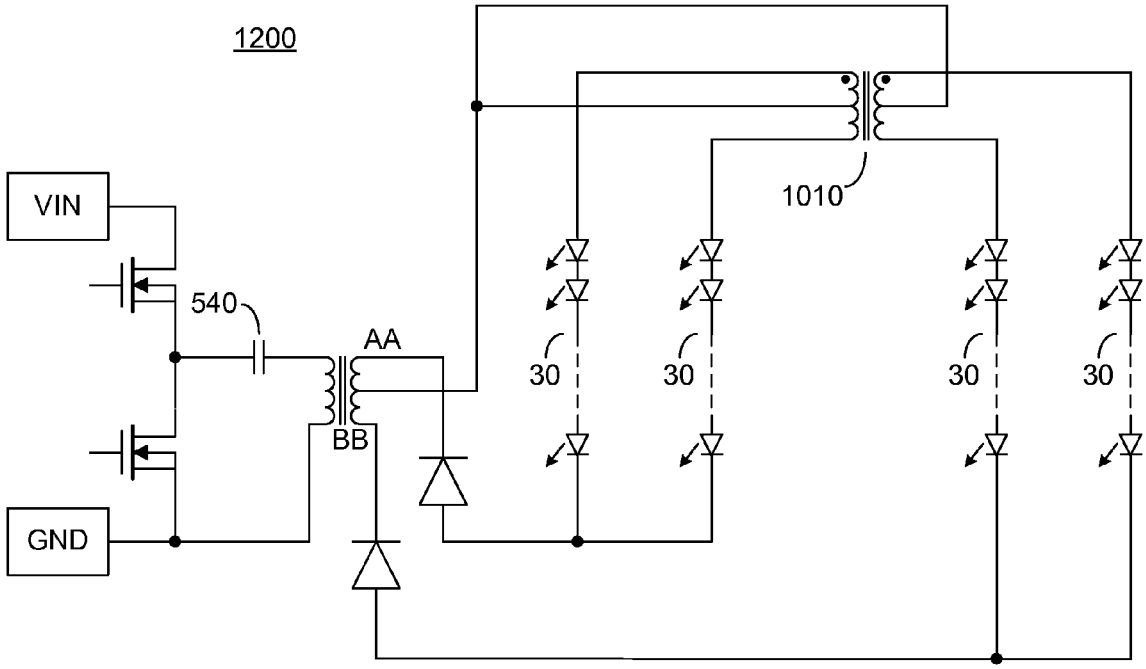
FIG. 12 illustrates the circuit architecture of FIG. 11, with a common cathode arrangement.

FIG. 12 illustrates a high level schematic diagram of an exemplary embodiment of a solid state lighting arrangement 1200, which is in all respects identical with solid state lighting arrangement 1100 with balancer transformer 1010 provided on the anode side of the various LED strings 30. Operation of lighting arrangement 1200 is in all respects similar to the operation of lighting arrangement 1000, and in the interest of brevity will not be further detailed.

Figure 13:
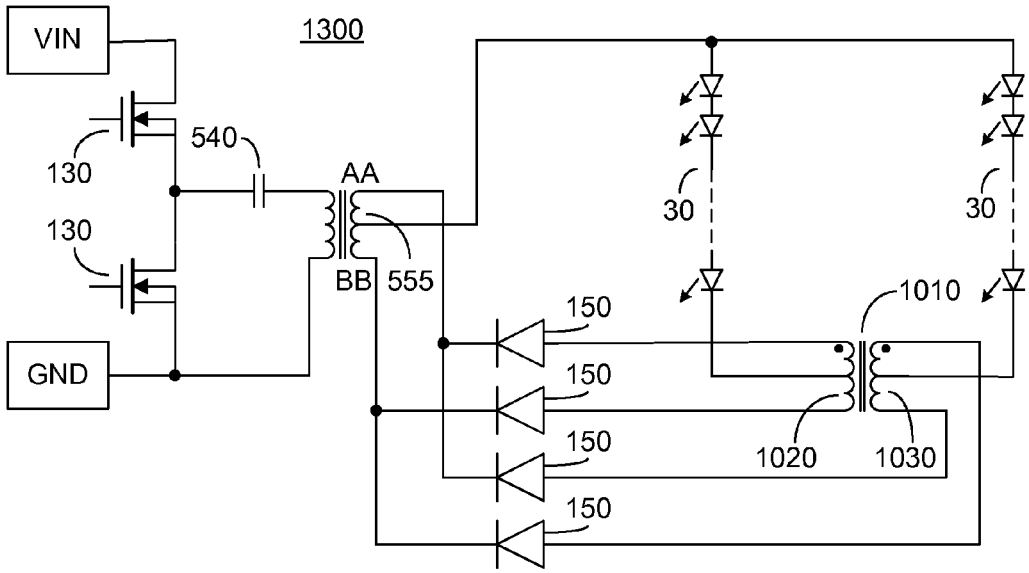
FIG. 13 illustrates a high level schematic diagram of an exemplary embodiment of the circuit architecture arranged to balance 2 LED strings with a single balancing transformer, wherein each LED string conducts in both half cycles of a switching converter.

FIG. 13 illustrates a high level schematic diagram of an exemplary embodiment of a solid state lighting arrangement 1300, wherein each winding of balancer transformer 1010 drives a single LED string 30. In particular, the center tap of secondary winding 555 is connected to the anode end of each LED string 30, first end AA of secondary winding 555 is connected to each of a first end of first winding 1020, denoted with a dot for polarity, and to a second end of second winding 1030, via a respective unidirectional electronic valve 150 and second end BB of secondary winding 555 is connected to each of a second end of first winding 1020 and to a first end of second winding 1030, denoted with a dot for polarity, via a respective unidirectional electronic valve 150. The cathodes of unidirectional electronic valves are connected to secondary winding 555 and the anodes of unidirectional electronic valves are connected to the respective windings 1020, 1030 of balancer transformer 1010. The cathode end of a first LED string 30 is connected to the center tap of first winding 1020 and the cathode end of a second LED string 30 is connected to the center tap of second winding 1030.

In operation, each LED string 30 of solid state lighting arrangement 1300 conducts in both half cycles and therefore the ripple current frequency of the LED strings 30 is twice the switching frequency of electronically controlled switches 130. On each side of balancer transformer 1010 half of the center tapped winding conducts current during one half cycle and the remaining half winding conducts current in during the other half cycle. Therefore the core of balancer transformer 1010 sees an AC excitation. The connection polarity of first winding 1020 opposes the connection polarity of second winding 1030 and thus ensures that the magnetization force generated by the current of the two LED strings 30 are in opposite direction, and as a result the current of the two LED strings 30 are equal.

Figure 14:
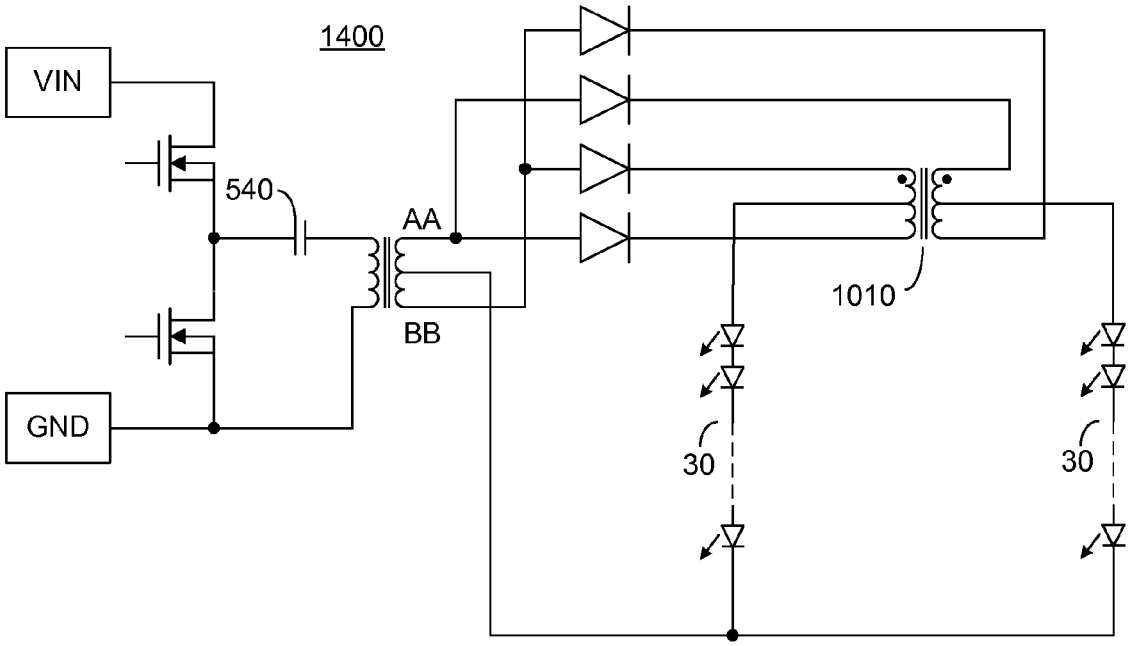
FIG. 14 illustrates the circuit architecture of FIG. 13, with a common cathode arrangement.

FIG. 14 illustrates a high level schematic diagram of an exemplary embodiment of a solid state lighting arrangement 1400, which is in all respects identical with solid state lighting arrangement 1300 with balancer transformer 1010 provided on the anode side of the various LED strings 30. Operation of lighting arrangement 1400 is in all respects similar to the operation of lighting arrangement 1300, and in the interest of brevity will not be further detailed.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. A solid state lighting driver arrangement comprising:

a bridge converter comprising a power transformer, a plurality of electronically controlled switches and a capacitor, the capacitor arranged in cooperation with the plurality of electronically controlled switches so as to prevent the flow of a steady state direct current through the primary winding of the power transformer, the bridge converter arranged to receive an input direct current voltage potential and provide an alternating current output across a secondary winding of the power transformer;

a plurality of light emitting diode (LED) strings, a first end of each of the plurality of LED strings coupled to the center tap of said secondary winding of said power transformer; and a balancer transformer with a pair of magnetically coupled center tapped windings, a second end of each of the plurality of LED strings coupled to a respective end of one of the first and second windings of said balancer transformer such that power on each half cycle output by the bridge converter is balanced between the LED strings receiving power during that half cycle by said respective balancer transform winding, and that power between the half cycles output by the bridge converter is balanced between the LED strings receiving power during each half cycle by said balancer transformer, a first end of the secondary winding of the power transformer coupled to the center tap of the first winding of said balancer transformer and a second end of the secondary winding of the power transformer coupled to the center tap of the second winding of said balancer transformer.

2. A solid state lighting driver arrangement comprising:

a bridge converter comprising a power transformer, a plurality of electronically controlled switches and a capacitor, the capacitor arranged in cooperation with the plurality of electronically controlled switches so as to prevent the flow of a steady state direct current through the primary winding of the power transformer, the bridge converter arranged to receive an input direct current voltage potential and provide an alternating current output across a secondary winding of the power transformer;

a first and a second light emitting diode (LED) string, one end of each of the first and second LED strings coupled to the center tap of said secondary winding of said power transformer, and a balancer transformer with a first and second magnetically coupled center tapped windings, a second end of said first LED string coupled to the center tap of the first winding of said balancer transformer, a second end of said second LED string coupled to the center tap of the second winding of said balancer transformer, the first end of the secondary winding of the power transformer coupled to a first end of the first winding of said balancer transformer and to a second end of the second winding of said balancer transformer;

the second end of the secondary winding of the power transformer coupled to a second end of the first winding of said balancer transformer and to a first end of the second winding of said balancer transformer.

3. The solid state lighting driver arrangement according to claim 2, wherein said coupling of the first end of the secondary winding of the power transformer to the first end of the first winding of said balancer transformer and to the second end of the second winding of said balancer transformer is via respective unidirectional electronic valves.

4. A solid state lighting driver arrangement comprising:

a bridge converter comprising a power transformer, a plurality of electronically controlled switches and a capacitor, the capacitor arranged in cooperation with the plurality of electronically controlled switches so as to prevent the flow of a steady state direct current through the primary winding of the power transformer, the bridge converter arranged to receive an input direct current voltage potential and provide an alternating current output across a secondary winding of the power transformer;

a first, second, third and fourth light emitting diode (LED) string, one end of each of said first and second LED strings coupled to a first end of the secondary winding of the power transformer, one end of each of said third and fourth LED strings coupled to a second end of the secondary winding of the power transformer, and a balancer transformer with a first and second magnetically coupled center tapped windings, a second end of each of said first, second, third and fourth LED strings coupled to a respective end of one of said first and second windings of said balancer transformer, the center tap of each of said first and second windings of said balancer transformer coupled to the center tap of said power transformer.

5. The solid state lighting driver arrangement according to claim 4, wherein said coupling said first, second, third and fourth LED strings to the respective end of one of said first and second windings of said balancer transformer comprises: a second end of said first LED string coupled to a first end of said first winding of said balancer transformer a second end of said second LED string coupled to a second end of said first winding of said balancer transformer; a second end of said third LED string coupled to a first end of said second winding of said balancer transformer; a second end of said fourth LED string coupled to a second end of said second winding of said balancer transformer.

* * * * *